United States Patent [19]

Rowe et al.

[11] 4,122,790

[45] Oct. 31, 1978

[54] PEEL-TOP CONTAINER ASSEMBLY SYSTEM

[75] Inventors: E. Riley Rowe; Wade Fletcher; Herman R. Markert; Dwight D. Grady, all of Hartsville, S.C.

[73] Assignee: Sonoco Products Company, Hartsville, S.C.

[21] Appl. No.: 796,216

[22] Filed: May 12, 1977

[51] Int. Cl.[2] ..... B21D 51/44

[52] U.S. Cl. ..... 113/120 R; 113/1 E; 113/14 R; 113/121 R

[58] Field of Search ..... 113/1 E, 1 F, 28, 29, 113/30, 116 QA, 116 Y, 120 R, 120 G, 120 XY, 121 R, 121 C, 14 R, 80 R, 80 D, 80 DA; 156/69; 29/773, 785, 786

[56] References Cited

U.S. PATENT DOCUMENTS

| | | | |
|---|---|---|---|
| 2,531,914 | 11/1950 | Lager et al. | 93/55.1 R X |
| 2,906,225 | 9/1959 | Evans | 113/121 R |
| 3,383,256 | 5/1968 | Carbone | 156/69 |
| 3,429,102 | 2/1969 | Hefner | 113/30 |
| 3,734,044 | 5/1973 | Asmus | 113/121 C |
| 3,908,572 | 9/1975 | Johnson et al. | 113/1 E |
| 3,959,061 | 5/1976 | Renck et al. | 113/80 D |
| 3,961,566 | 6/1976 | Westphal et al. | 93/36 B |
| 3,977,340 | 8/1976 | Geeson | 113/30 |
| 4,047,473 | 9/1977 | Fletcher et al. | 93/36 B |

*Primary Examiner*—Michael J. Keenan
*Attorney, Agent, or Firm*—Dennison, Dennison, Meserole & Pollack

[57] ABSTRACT

A system for forming and mounting end closures for peel-top containers, each closure including a peelable sealing membrane, with a folded pull tab, and a separate plastic overcap. The individual sealing membranes are cut from a continuous web and deposited directly on the open ends of cans or containers being fed in a continuing line. Each membrane is retained in properly oriented association with the corresponding container, by adhesive tacking or through a partial vacuum generated within the container, until such time as the container supported membrane is engaged by a chuck to effect a positive sealing of the membrane to the container. After a sealing of the membrane to the container, the container proceeds through a cycle wherein the tab on the membrane is laterally bent, the overcap is applied, and the container with completed end closure is discharged. Embossing of each membrane is normally selectively done so as to occur only over the area thereof inward of the peripheral portion which engages the container.

13 Claims, 7 Drawing Figures

114
116
94
102
4
40
10
72
72
50
20
4
70
98
108
68
16
66
58
46
5
5
30
30
18
66

PEEL-TOP CONTAINER ASSEMBLY SYSTEM

BACKGROUND OF THE INVENTION

The invention herein is concerned with peelable sealing membranes for container ends, and the manner of forming and mounting such membranes on the associated containers. The assembly apparatus and method also provide for the formation and folding of a gripping tab and the mounting of an overcap over the container mounted membrane.

The state of the known prior art is best exemplified by application Ser. No. 586,011 filed June 1, 1975, now U.S. Pat. No. 4,047,473, and assigned to the same assignee as the present application, and also the following three patents:

U.S. Pat. Nos. 3,734,044 to Asmus et al.; 3,892,351 to Johnson et al.; 3,988,185 to Johnson et al.

Heretofore, problems have been encountered in the efficient forming, handling and mounting of peelable flexible foil membranes on container ends in a manner so as to provide an effective seal for such ends. Basically, the problems arise due to the extremely thin and flexible nature of the individual membranes which make the handling and application thereof both difficult and time consuming. In this regard, it will be noted that the co-pending application accommodates the extremely thin membranes by a positioning of the membranes directly on holders and in turn enclosing the individual membranes within overcaps which act in effect as a carrier for subsequent application of the membrane and overcap as a unit to the containers. The patent to Asmus et al. refers to the provision of an annular groove directly at the point of attachment of the membrane to the can for an accommodation of the bead of the can. The patents to Johnson et al. are concerned with the specific manner of heat sealing the membrane to the container by utilizing electrically conductive components and subjecting them to a high frequency electrical field. It will also be noted in Johnson et al. that the sealing of the membranes to the containers is effected subsequent to the mounting of the overcap within which the membrane is supported.

SUMMARY OF THE INVENTION

The system herein is concerned with the provision of a complete closure on one end of a container or container body, including the reception and proper orientation of the container, the forming and mounting of the inner peelable membrane, the positioning of the membrane tab, and the application of the overcap.

Basically, the container is positioned with one beaded end uppermost and conveyed, by a continuously moving conveying apparatus, to a punching station at which point punching means severs a membrane from a transversely traveling web and simultaneously applies the punched membrane to the beaded end of the container immediately therebelow. The membrane is retained on the rim of the container by either the generation of a partial vacuum or suction within the container, or by adhesive tacking of the membrane to the rim, this normally being effected by the use of a heated punch with the under surface of the membrane itself being coated by a suitable heat activated adhesive. Alternatively, the membrane can be retained by a combination of both an internal vacuum and a partial adhesive tacking. The container, with the partially secured or stabilized membrane thereon, continues to a second conveying unit which, also in a continuing operation, orients the container for engagement of the membrane covered upper end thereof with a hot chuck which continues with the traveling container through a cycle, or along a path of travel, sufficient so as to completely fix and seal the membrane to the container. The container then proceeds through a cooling cycle, normally utilizing a third conveying device, with the cooling cycle ultimately transporting the container to a tab folding station, an overcap applying station and a discharge or collection station.

The membrane itself, while normally a metallic foil, may be of other materials, such as for example a foil-like plastic having a fusion temperature sufficiently greater than that of the hot melt adhesive so as to not be affected by either the hot punch or the hot chuck.

Further, the invention proposes the embossing of each membrane so as to provide a stiffening effect while still retaining the planar nature of the membrane, the embossing actually being done on the web of material prior to the punching and depositing of the membrane. It is contemplated that the embossing be provided only in that area corresponding with the internal area of the can, excluding that portion of the membrane which engages the container rim or bead for adhesive attachment thereto. In this manner, a completely smooth membrane surface will be presented to the can bead to insure a proper bonding and sealing to the bead. If so desired, a grip enhancing embossing may be provided on the membrane tab. The provision of embossing or an embossed pattern on the membrane will also tend to substantially reduce any denting of the membrane by the contents of the filled container.

DESCRIPTION OF THE PREFERRED EMBODIMENT

Figure 1:
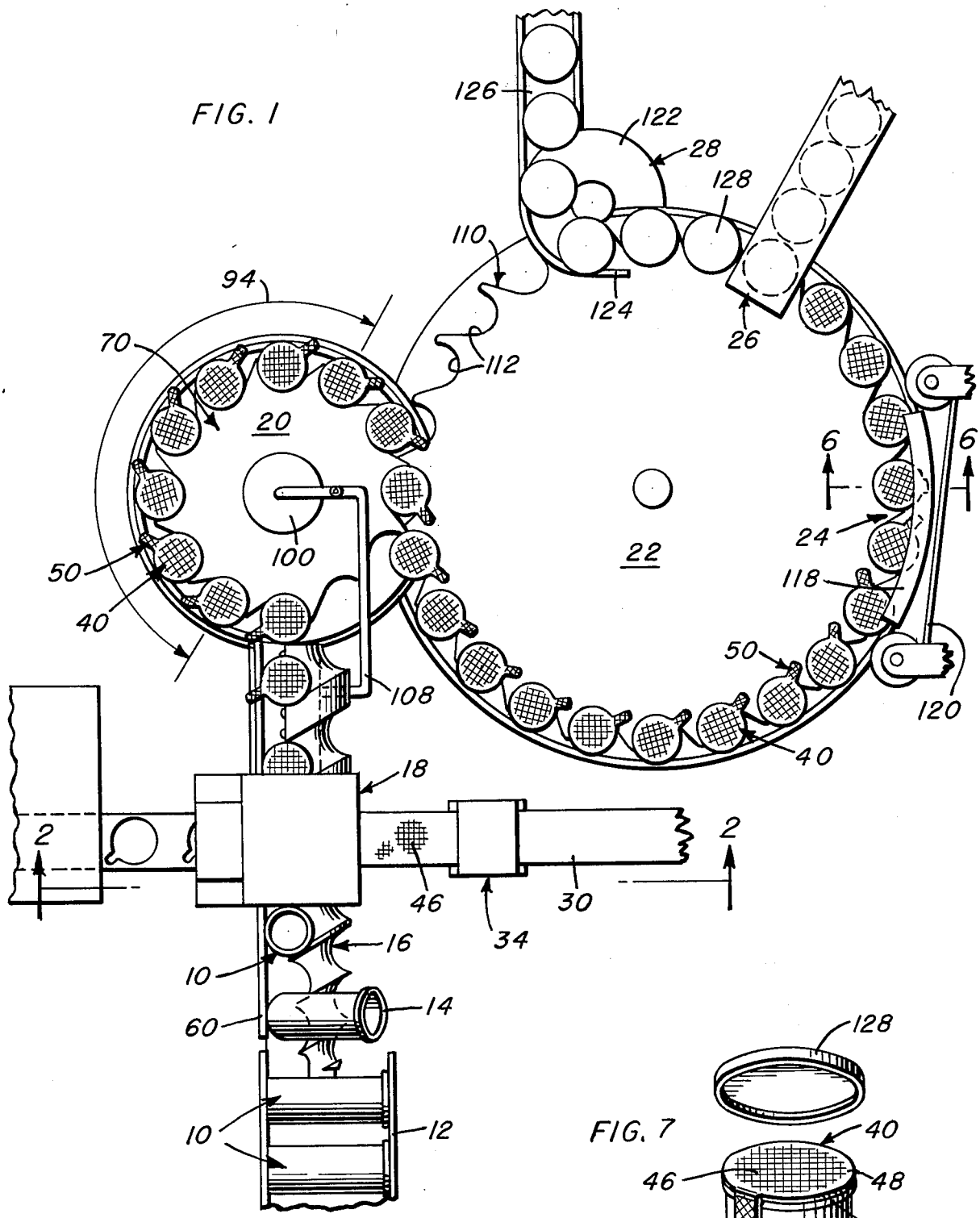
FIG. 1 is a top plan view of the general overall system comprising the present invention.

Attention is directed initially to FIG. 1 wherein the overall system is illustrated. Starting at the bottom of FIG. 1, the container bodies, hereinafter referred to as containers 10, are introduced horizontally, utilizing any appropriate infeed system 12. Each container includes an outwardly rolled rim or bead 14 at one end thereof which is subsequently upwardly directed upon a movement of the container 10 to a vertical position in a conventional manner at the inlet section of an elongated feed screw conveyor 16. The feed screw conveyor 16, as is the entire assembly, is continuously operating and carries the vertically oriented containers 10 to and through a membrane punching and positioning station 18, and therebeyond to a rotary starwheel conveyor 20 which carries each container and membrane through a sealing cycle. The rotary starwheel conveyor 20 subsequently discharges the container 10 to a relatively larger rotary starwheel conveyor 22 which carries the container through a cooling cycle, a tab folding station 24, a capping station 26, and a discharge station 28.

Extending transversely across the feed screw conveyor 16, at the membrane punching and positioning station 18, will be a web 30 of membrane forming material. The membrane web 30 will normally be provided in a supply roll 32 rotatably mounted to one side of the feed screw 16 and punching station 18, with an embossing station 34 provided between the supply roll 32 and the punching station 18. Any suitable pull means for effecting an intermittent drawing of the web 30 through the embossing and punching stations can be provided to the opposite side of feed screw 16 and punching station 18. As one example, notice FIG. 2, upper and lower pull rolls 36 can be used. If desired, appropriate chopper means 38 can be provided beyond the pull rollers 36 for disposal of the scrap portion of the web subsequent to the punching ofthe membranes 40 therefrom.

Figure 3:
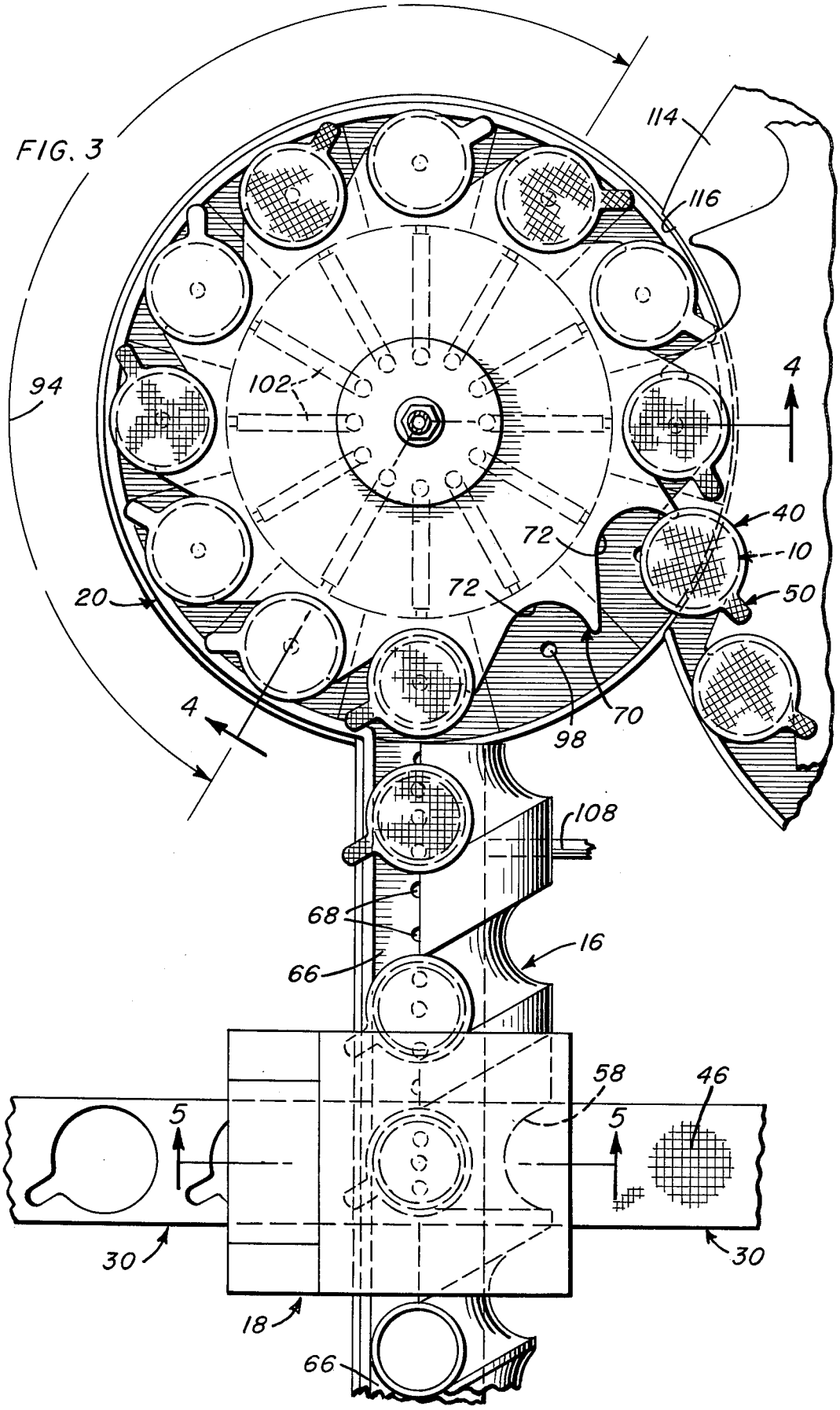
FIG. 3 is an enlarged plan detail of the membrane forming and mounting portion of the system.

The embossing station 34 will basically include a web underlying rubber-faced backup plate 42 and a web overlying vertically reciprocating power-driven embossing pad 44. While not specifically limited thereto, it is preferred that the area of embossing, designated by reference numeral 46 in FIGS. 1 and 3, correspond to the inner cross-sectional area of the container 10, inward of the bead or rim 14. In this manner, the rigidity and stability desired for the membrane 40 will be achieved while still maintaining smooth upper and lower faces circumferentially about the embossed central section 46 of the formed membrane 40 so as to insure a proper sealing engagement with the container bead or rim 14. In other words, in order to avoid any possibility of the embossing affecting the desired seal of the membrane to the container rim 14, the embossing will normally be terminated inward of that portion of the membrane 10 which contacts the container rim. This arrangement will be best noted from FIG. 7. Further, inasmuch as each membrane 40 is to include a projecting pull tab 50, appropriate embossing, so as to enhance the grip, can also be provided thereon. This in turn will result in the provision of an embossing pattern on the unsevered web substantially as illustrated in FIGS. 1 and 3.

Figure 2:
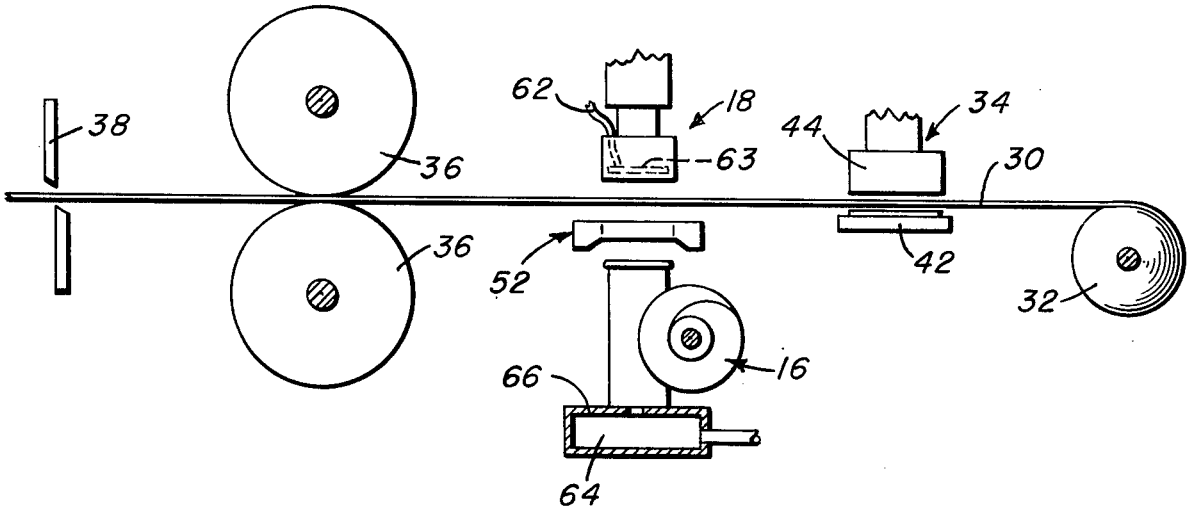
FIG. 2 is a cross-sectional detail taken substantially in the plane of line 2—2 in FIG. 1.
Figure 5:
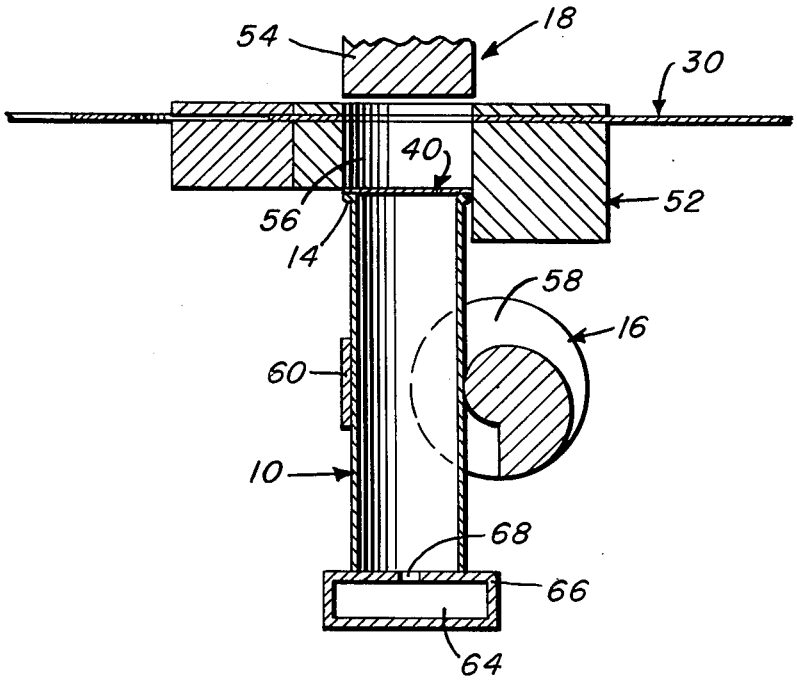
FIG. 5 is a cross-sectional detail taken substantially on a plane passing along line 5—5 in FIG. 3.

Noting the generally schematic view of FIG. 2 and the cross-sectional detail of FIG. 5, the membrane punching and positioning station includes a block 52 through which the web 30 is fed and a cooperating vertically reciprocating overlying punch 54 which coacts with the block 52 in severing the membrane and positioning the membrane on a subjacent container 10. The block 52 includes a vertical passage 56 therethrough in alignment with the web 30, the punch 54 entering into the upper portion of the passage 56 and cooperating with the upper peripheral edge of the passage to sever the individual membranes 40 from the web 30 in basically a conventional punching operation. Each punched membrane 40 is in turn positioned, by the downwardly traveling punch 54, directly on the upper beaded end of an aligned container 10, there being no free-fall or independent transporting of the membrane 40 such as could result in a misorientation thereof. As will be appreciated, the cross-sectional area of the passage 56, as well as the configuration of the punch 54, are such as to cut the membrane free in the desired configuration, this normally being as illustrated with a circular container closing main portion and, if so desired, a projecting integral pull tab 50.

As previously indicated, the containers 10 are moved to, through and beyond the membrane punching station 18 by means of a continuously rotating feed screw conveyor. In order to effect a pause in the travel of each container 10 at the punching station 18 in alignment with the vertical passage 56, the feed screw 16 incorporates a semi-circular dwell section in the thread thereof. While not commonly used, feed screws with dwells of this type so as to effect a momentary pause in the transporting of an item are known. As further suggested in FIG. 5, the containers 10 can be stabilized both during their travel along the feed screw 16 and at the punching station 18 by a guide rail 60 spaced from the feed screw 16 so as to accommodate the moving containers 10 therebetween, and by the provision of a depending abutment on the block 52 against which the upper portion of each container 10 engages. It is of course contemplated that the apparatus be synchronized in any appropriate manner so as to deliver and momentarily hold each container 10 in alignment with the downwardly moving punch 54 for the proper depositing of the membrane 40. The movement of the punch 54 is in turn synchronized with the embossing operation occuring at the embossing station 34. These operations are in turn coordinated with the intermittent pulling of the membrane web 30.

It is contemplated that the membranes 40 be sealed to the containers 10 by means of an appropriate heat activated adhesive. This adhesive will normally be provided as a coating on the undersurface of the membrane web 30 and thus entirely coat the undersurface of the punched membrane 40. In order to properly retain each membrane 40 in position on the beaded end of the associated container 10 until such time as the membrane can be permanently sealed to the container, as shall be explained subsequently, the system herein proposes a combination of means which, if so desired, may be used independently of each other. One such means consists of a heat tacking of each membrane to the associated container rim. This is effected by a partial activation of the membrane adhesive utilizing a heated punch 54. The punch 54 can be heated in any appropriate manner with the heat thereof, in combination with the physical pressure of the punch in seating the membrane 40 on the container bead 14, being sufficient so as to effect a non-sealing tacking of the membrane to the rim to insure a retention of the membrane in accurate position on the container until such time as a more permanent affixation and sealing of the membrane to the container can be effected. The permanent sealing of the membrane to the container at the punching station is not contemplated in that an extremely high speed operation is proposed wherein as much as 400 or more containers will be lidded per minute. In FIG. 2, 62 schematically illustrates leads from a power source to an electric heating element 63 provided internally within the hot punch, as one example of means for providing the desired heat.

Another means for temporarily adhering each membrane 40 to its associated container 10, either supplementing the holding effect of the heat tacking or as a substitution therefor, involves the generation of a partial vacuum within each container 10 with the reduced atmosphere in the container resulting in an inward drawing of the membrane against the container bead 14. This vacuum effect within the interior of the containers can be provided by means of a vacuum chamber 64 defined below that portion of the container support floor 66, associated with the screw conveyor 16, which extends through the punching station 18 and from there to the rotary conveyor 20. The top wall of the chamber 64, or container support floor 66, will include either an elongated slot or a series of openings 68 for communication of the vacuum chamber 64 with the interior of the containers 10 through the open bottoms thereof.

The first rotary conveyor unit 20 is particularly adapted to convey the containers with the seated membranes thereon through a cycle or elongated station wherein the membranes are heat-sealed to the container ends. One form of rotary conveying unit 20 has been illustrated in the drawings and will be best appreciated from FIGS. 3 and 4. Basically, a pair of upper and lower pocketed starwheels 70 are provided with the pockets 72 of the starwheels 70 being oriented in vertically aligned pairs for engagement with the upper and the lower portions of a container 10 received therein. It is contemplated that each of the pockets be of a depth and a curvature so as to encompass a major portion of the container in a manner which will avoid any distortion of the container. This is considered significant in view of the relative weakness of composite containers, of the type particularly herein contemplated, as well as the lack of the substantial flexure strength in the membranes. Underlying each vertical set of starwheel pockets 72 is a roller mounted base 74, generally in the shape of a truncated sector, with the circumferentially aligned series of bases 74 defining a complete circle. Each of the bases 74 is movable for traveling with the starwheels 70 thereabove, preferably by mounting on an appropriate roller carriage 76 which travels on an underlying circular table or deck 78. While not necessarily limited thereto, a single power-driven central shaft 80 can be used to effect a synchronized driving of the starwheels and bases. In the case of the bases 74, a central hub 82 can be affixed to the shaft with radiating arms 84 engaged between the hub 82 and each of the bases 74. Each of the starwheels 70 can be provided with an appropriate central hub 86, also affixed to the shaft 80.

In order to effect a sealing of each membrane 40 to the associated container 10, a series of hot or heated chucks 88 are provided in overlying relation to the conveying unit 20, one aligned with each container receiving set of pockets 72 for selective engagement with the container supported membrane 40. Through any appropriate means, each chuck 88 will rotate with its associated set of starwheel pockets 72 whereby, as shall be explained presently, an extended heating cycle is provided as required to achieve an effective and complete sealing of each membrane to its container.

The upper surface or container receiving floor 90 of each base 74, as it aligns with the container support floor 66 associated with the screw conveyor 16, is coplanar therewith so as to freely and slidably receive the individual containers 10 through the combined discharge action of the screw conveyor 16 and the pick up action of the starwheel pockets. At this point, the associated hot chuck 88 is spaced upwardly from the membrane covered end of the vertical container 10 approximately 3/16 to ¼ inch. As the base supported container 10 is moved clockwise around the starwheel conveyor 20, the associated supporting base 74 is raised a distance sufficient so as to engage the upper container end, and membrane 40, against the lower surface of the heated chuck 88 traveling therewith. This elevating of the container into engagement with the heated chuck can be effected by the provision of a camming member 92 provided on the table or deck 78 within the path of movement of the carriage supported bases 74. It is proposed that the cam 92 be arcuate and elongated whereby engagement with the hot chuck 88 is maintained throughout approximately a 180° revolution as suggested by arc line 94. The cam 92 can actually be in the nature of an elevated track having inclined ramps at the opposed ends thereof to allow for a smooth movement of the carriage supported bases 74 both from and back to the main deck 78.

The chucks 88 will be heated in any conventional manner and be capable of applying sufficient heat to the membrane adhesive as to effect a complete activation thereof, at least in the area of the rim to which the membrane is to be bonded and sealed. By the same token, the relationship between the generated heat and the material of the membrane is to be such so as to have no effect on the membrane itself. Further, it is proposed that provision be made for controlling the temperature of the chucks, for example within a range of 250° to 550° Fahrenheit. Also, the heat sealing chucks 88 will normally be allowed to float to some degree so as to provide uniform contact with the membrane and bead, the actual pressure exerted by the chuck likewise being adjustable, normally within a range of from 60 to 100 pounds.

Figure 4:
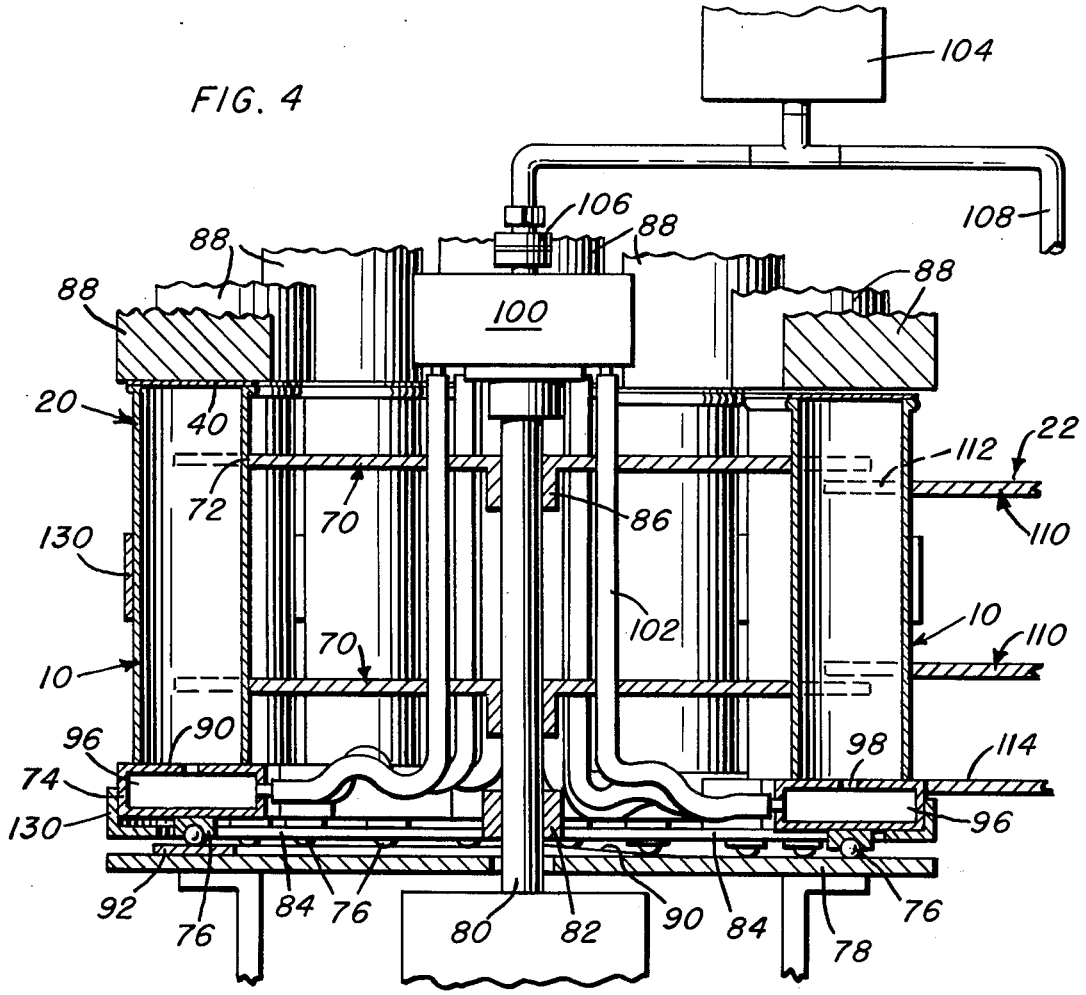
FIG. 4 is a cross-sectional detail taken substantially on a plane passing along line 4—4 in FIG. 3.

With particular reference to FIG. 4, attention is directed to the fact that each base 74 will preferably define a hollow internal chamber 96 within which a partial vacuum will be generated so as to, through an appropriate opening 98 in the base floor 90, communicate with the interior of the container 10 received thereover so as to continue to maintain the suction retention of the membrane 40 on the container 10 subsequent to passage of the container 10 beyond the vacuum chamber 64 associated with the feed screw conveyor and until such time as the associated hot chuck 88 forcibly engages the membrane against the container bead. As one manner of providing for the desired vacuum or partial vacuum within each base chamber 96, a central manifold 100 can be provided immediately above the conveying unit for rotation therewith, with individual flexible vacuum lines 102 extending from the manifold to each base chamber 96. The manifold 100 can in turn connect to an appropriate vacuum pump 104, or like means for generating the desired reduced pressure, through a rotary union 106. Incidentally, the same vacuum source 104 can, through a separate line 108, generate the desired vacuum within the vacuum chamber 64 associated with the feed screw conveyor 16.

The retention of the heated chuck 88 in engagement with the container received membrane throughout an extended length along the path of travel of the container is considered significant so as to insure a proper activation of the adhesive and a sealing of the membrane during the contemplated high speed operation. For example, while the heat tacking of the membrane to the container at the punching station can be effected in as little as 0.06 second, the actual heat sealing of the membrane may require as much as 1/2 second or more. Thus, by effecting this heat sealing as the container continues to move along a path, a continuous high speed operation can be maintained.

After the individual container has been subjected to the pressure and heat of the hot chuck for a sufficient length of time, this normally entailing rotation of the container through an arc of approximately 180° by the starwheel conveyor 20, the container is lowered away from the associated chuck 88 so as to begin a cooling cycle about a selected portion of the first starwheel 20 and a substantially major portion of the second starwheel conveyor 22. Incidentally, while the vacuum within each of the base chambers 96 may be maintained throughout the complete rotation of the base 74 as a matter of manufacturing convenience, this vacuum, while sufficient so as to properly maintain the membrane, will not interfere with the sliding of the membrane sealed containers 10 to the second starwheel conveying unit 22.

With reference to FIGS. 1 and 4 in particular, the second starwheel conveyor unit 22 may also consist of a pair of vertically spaced starwheels 110 provided with a series of vertically aligned container receiving pockets 112 thereabout. The pockets 112 are of a size and configuration so as to nestably seat the containers 10 therein without damage thereto. As will be appreciated from the drawings, the starwheels 110 rotate counterclockwise and overlap the starwheels 70 in the discharge area thereof for a smooth transfer of the now cooling containers to the starwheel conveyor 22. The starwheel conveyor 22 also includes a fixed circular deck or floor 114 generally co-planar with the container receiving surfaces of the bases 74 in their lowered position thereof for a smooth transfer of the containers 10. Note in FIG. 3, an appropriate arcuate cut-out 116 can be provided in the deck 114 to facilitate a container transferring orientation of the conveying units 20 and 22.

Figure 6:
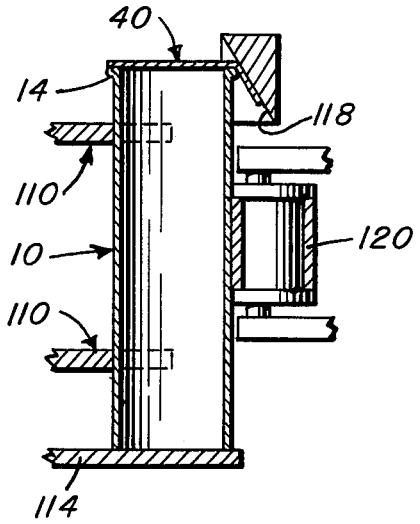
FIG. 6 is a cross-sectional detail taken substantially on a plane passing along line 6—6 in FIG. 1.

In those instances, as will usually be the case, wherein the membrane 40 is to be provided with a pull tab 50, the container 10, after traveling a predetermined cooling path, will enter the tab folding station 24. This station basically consists of an overlying angularly turned camming surface 118 against which the horizontally directed tab 50 engages and by which the tab is deflected to the desired position, either vertically downward along the side of the container 10 as suggested in FIGS. 6 or 7, or to any other appropriate position, such as for example in direct overlying relation to the membrane upper surface. Further, in order to insure a proper orientation of each of the tabs 50 for engagement by the camming surface 118, it is contemplated that a power-driven endless belt 120 be so positioned as to engage and rotate the containers 10 as they enter and travel through the tab folding station 24.

The overcapping station 26 can, if so desired, basically utilize apparatus of the type shown in U.S. Pat. No. 4,003,117, issued Jan. 18, 1977. This would involve merely a vertical orientation of the apparatus whereby the overcaps will be wiped on the membrane covered ends of the containers as they are propelled therepast by the pair of starwheels 110. Immediately beyond the overcapping station 26 is the discharge station 28 wherein any suitable means can be provided for effecting a discharge of the covered containers 10. As illustrated, this can consist of a rotating discharge plate 122 cooperating with a deflecting arm 124 and a discharge chute 126.

The extended period of cooling, provided for by the length of the cooling path from release of the container from the chuck to the tab folding station, is desirable so as to insure a sufficient cooling of the membrane whereby the membrane will not be disturbed by either the tab folding operation or the wiping on of the overcap. It will be noted that the cooling is effected while the apparatus is maintained in continuous operation.

Figure 7:
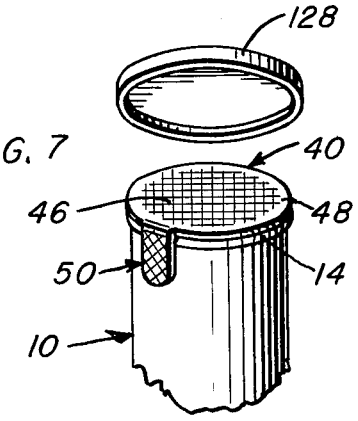
FIG. 7 is a perspective detail of the upper portion of a container with the membrane mounted thereon and with the overcap moved away therefrom.

Various modifications and changes are also contemplated within the scope of the system as detailed above. For example, if the tab 50 is to be oriented in depending relation to the membrane and along the side of the container 10 as shown in FIG. 7, it is possible that the actual folding of the tab can be accomplished by the overcap 128 as it is wiped onto the container. Further, and as actually suggested in FIG. 4, side rails or the like 130 can be provided so as to assist in properly retaining and moving the containers 10.

While the system as illustrated contemplates a natural cooling of the membrane ends subsequent to a removal of the hot chucks, an appropriate forced cooling means can also be used. Likewise, while rotating conveyors of the type illustrated are considered most practical, linear conveyors might also be adapted to the system of the invention. Also, there exist the possibility of heating or preheating the container rims to provide the necessary heat to activate the adhesive sufficient for a tacking of the membrane thereto. This would eliminate the necessity of heating the punch which is to cut and position the membrane.

Further, engagement of the hot chucks 88 with the membrane covered upper ends of the containers 10 can be effected by a vertical shifting of the hot chucks themselves, rather than the described elevating of the containers 10 which, incidentally, at least in the embodiment illustrated, requires that the base controlling arms 84 be capable of accommodating the slight vertical shift of the bases as the bases ride onto and off of the cam 92.

In some circumstances, the adhesive, rather than appearing as a coating on the undersurface of the web material, could be applied directly to the container rim. In such cases, the adhesive used may be a pressure sensitive adhesive which will tack the membrane to the container rim upon a pressure contacting of the membrane therewith by the punch. The use of a pressure sensitive adhesive will, in turn, enable a cutting off of the heat to the punch and the hot chucks, with the chucks providing the necessary pressure to effect the complete sealing.

It is to be appreciated that a particularly significant feature of the present invention is the direct temporary securing, by tacking or by vacuum, of the membrane to the end of the container simultaneously with the cutting of the membrane. This enables the use of extremely thin and flexible membranes without the necessity of providing some manner of strengthening or supporting the membrane such as is required in apparatus now in use wherein the membrane is separately formed and conveyed to a remote point of application to the container. The direct temporary tacking or vacuum securing of the membrane to the container also eliminates the problem of conveying a container with a loose membrane thereon to the sealing station.

While not specifically limited thereto, the membrane will normally be of a thin metallic foil, for example, 0.0025 inch dead soft aluminum foil coated on one side with a heat activated sealant. This foil can be provided with a film of polyester or the like on the top surface thereof, depending upon the particular application. Likewise, it is also possible that the membrane be formed of a nonmetallic foil-like material.

With reference to FIG. 7 in particular, it is again noted that while the embossing 46 can encompass the full area of the membrane 40 and tab 50, it is preferred that this embossing not occur in the rim portion 48 of the membrane, that is the portion of the membrane which is to be adhesively affixed to the container rim 14. In this manner, a more complete adhering and sealing of the membrane 40 can be achieved while at the same time obtaining the desired benefits of the embossing, including increased strength and structural stability.

The foregoing is considered illustrative of the principles of the invention. Since, as indicated, modifications and variations are contemplated, it is not desired to limit the invention to the exact construction and operation as shown and described. Rather, all suitable modifications and variations may be resorted to, falling within the scope of the invention as claimed.

I claim:

1. A high speed system for mounting end closures on containers, said system comprising means for introducing a series of containers to a given path, first conveying means for moving the series of containers along the given path, through a first station, means at said first station for forming and positioning a thin flexible generally planar membrane on one end of each container, second conveying means beyond said first conveying means and cooperating therewith for continuous movement of the containers beyond the first station, along the given path and through multiple subsequent stations, a second station along said path beyond said first station, means at said second station for sealing each membrane to its associated container as the container moves continuously therethrough, means for retaining each membrane on the associated container as it moves along the path between the first and second stations comprising means for temproarily adhesively tacking the membrane to the container and further comprising vacuum means at the end of the container remote from the membrane for developing a partial vacuum within the container, said vacuum means including a planar floor surface for support and sliding movement of the containers thereon, a third station along said path beyond said second station, and means at said third station for applying an end enclosing overcap over the membrane received end of each container as the container moves continuously therethrough.

2. The system of claim 1 including a further station along said path between said second and third stations, and means at said further station for folding a portion of said membrane laterally of the plane of the membrane.

3. The system of claim 2 wherein the means for forming and positioning the membrane includes a web of membrane material and punch means for severing a membrane from the web material and moving the severed membrane to seated engagement with one end of an associated container, and means for embossing selected portions of the web, prior to severing of the membrane, to correspond to selected portions of the membrane.

4. The system of claim 1 wherein said second station extends along a predetermined portion of the path, said means at said second station for sealing each membrane to the associated container comprising means for applying adhesive activating heat to the membrane along the length of the predetermined portion of the path comprising the second station as the container continuously traverses said predetermined portion of the path.

5. The system of claim 4 wherein the means for applying adhesive activating heat comprises a series of independent heated chucks, one of which is associated with each membrane mounting container during the continuous travel thereof through the second station.

6. A high speed system for mounting end closures on containers, said system comprising means for introducing a series of containers to a given path, first conveying means for moving the series of containers along the given path, through a first station, means at said first station for forming and positioning a thin flexible generally planar membrane on one end of each container comprising a web of membrane material and punch means for severing a membrane from the web material and moving the severed membrane to seated engagement with one end of an associated container, and means for embossing selected portions of the web, prior to severing of the membrane, to correspond to selected portions of the membranes, second conveying means beyond said first conveying means and cooperating therewith for continuous movement of the containers beyond the first station, along the given path and through multiple subsequent stations, a second station along said path beyond said first station, means at said second station for sealing each membrane to its associated container as the container moves continuously therethrough, means for retaining each membrane on the associated container as it moves along the path between the first and second stations comprising means for temporarily adhesively tacking the membrane to the container, a third station along said path beyond said second station, and means at said third station for applying an end enclosing overcap over the membrane received end of each container as the container moves continuously therethrough.

7. The system of claim 6 wherein said second station extends along a predetermined portion of the path, said means at said second station for sealing each membrane to the associated container comprising means for applying adhesive activating heat to the membrane along the length of the predetermined portion of the path comprising the second station as the container continuously traverses said predetermined portion of the path.

8. A high speed system for mounting end closures on containers, said system comprising means for introducing a series of containers to a given path, first conveying means for moving the series of containers along the given path, through a first station, means at said first station for forming and positioning a thin flexible generally planar membrane on one end of each container, second conveying means beyond said first conveying means and cooperating therewith for continuous movement of the containers beyond the first station, along the given path and through multiple subsequent stations, a second station along said path beyond said first station, means at said second station for sealing each membrane to its associated container as the container moves continuously therethrough, means for retaining each membrane on the associated container as it moves along the path between the first and second stations, a third station along said path beyond said second station, and means at said third station for applying an end enclosing overcap over the membrane received end of each container as the container moves continuously therethrough, the means for retaining each membrane on the associated container comprising vacuum means at the end of the container remote from the membrane for developing a partial vacuum within each container, said vacuum means including a planar floor surface for support and sliding movement of the containers thereon.

9. The system of claim 8 including a further station along said path between said second and third stations, and means at said further station for folding a portion of said membrane laterally of the plane of the membrane.

10. The system of claim 8 wherein the means for forming and positioning the membrane includes a web of membrane material and punch means for severing a membrane from the web material and moving the severed membrane to seated engagement with one end of an associated container, and means for embossing selected portion of the web, prior to severing of the membrane, to correspond to selected portions of the membranes.

11. In a method of mounting end closures on containers, the steps of introducing and moving a series of containers along a given path, forming and substantially simultaneously applying a membrane over an open end of each container at a given point along the path, temporarily retaining each membrane on an associated container by the development of a partial vacuum within the full height of the associated container, continuously moving the container and membrane along the path beyond said given point, sealing the membrane to the container end during the continuous movement of the container, and applying an end enclosing overcap over the membrane received end of the container during the continuous movement of the container.

12. In a method of mounting end closures on containers, the steps of introducing and moving a series of containers along a given path, forming and substantially simultaneously applying a membrane over an open end of each container at a given point along the path, temporarily retaining each membrane on an associated container, continuously moving the container and membrane along the path beyond said given point, sealing the membrane to the container end by heat activation of a heat activated adhesive during the continuous movement of the container, cooling the container and membrane sealed thereto during the continuous movement of the container and applying an end enclosing overcap over the membrane received end of the container during the continuous movement of the container.

13. A method for forming a sealing membrane for the open end of a container having a peripheral rim thereabout, said method including the steps of embossing a web of membrane material in an area corresponding to that of the open end of the container inward of the rim thereof, severing a membrane from the web with the embossed area generally centrally therewithin and surrounded by a portion without embossing and corresponding to the container rim for a subsequent sealing of the membrane to the container rim with the area without embossing directly engaging the rim.

* * * * *